United States Patent [19]

Weiss

[11] 3,984,934

[45] Oct. 12, 1976

[54] REMOVABLE SAFETY TRIGGER FOR FIREARMS

[75] Inventor: David Y. Weiss, New York, N.Y.

[73] Assignee: The Raymond Lee Organization, Inc., New York, N.Y.

[22] Filed: July 14, 1975

[21] Appl. No.: 595,385

[52] U.S. Cl. ..... 42/70 R; 42/69 R

[51] Int. Cl.[2] ..... F41C 17/00

[58] Field of Search ..... 42/1 Y, 70 E, 70 R, 42/69 R

[56] References Cited

UNITED STATES PATENTS 1,079,855 11/1913 Guarino ..... 42/1 Y

*Primary Examiner*—Charles T. Jordan

*Attorney, Agent, or Firm*—Stephen Wyden

[57] ABSTRACT

A trigger is removably mounted in a trigger mount that operates the firearm when the trigger rotates the trigger mount. The trigger may be removed and carried on a key chain.

1 Claim, 3 Drawing Figures

REMOVABLE SAFETY TRIGGER FOR FIREARMS

I have invented a new removable safety trigger for firearms which has the advantage that once removed, it is extremely difficult to discharge the firearm by accident. When not in use the trigger can be kept on a key chain.

My invention can be understood in view of the accompanying figures.

Figure 1:
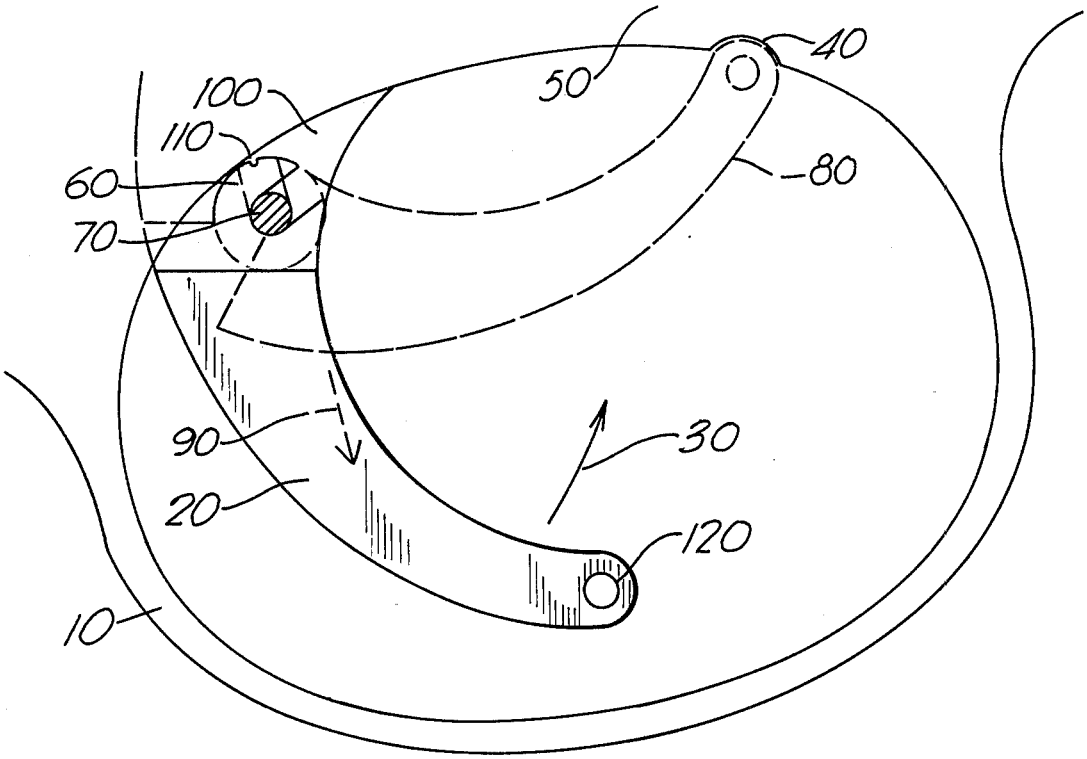
FIG. 1 shows the trigger mounted in the trigger guard.

In FIG. 1, trigger guard 10 normally protects the trigger 20 from accidental discharge. This trigger 20 can be pivoted forward 30 until it hits a recess 40 in the firearm housing 50 at which point the slot 60 in the trigger is aligned with the retaining pin 70 so that the trigger 80 (in phantom) can be pulled down and out 90 of the trigger mount 100. A pressure releasing ball 110 locks the trigger 20 in the operating position and a hole 120 in the tip of the trigger 20 can be used to carry the trigger 20 on a key chain.

Figure 2:
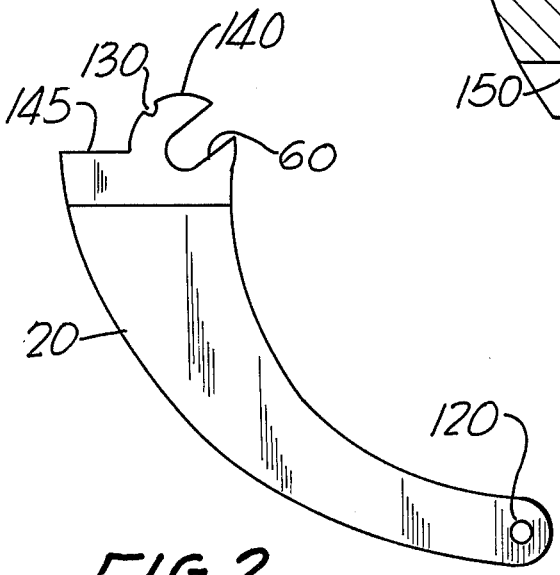
FIG. 2 shows the trigger in side view.

In FIG. 2, the trigger 20 with key chain hole 120, slot 60, pressure releasing ball socket 130 on the round upper edge 140 of the trigger, and the flat surface 145 that acts on the trigger mount to fire the weapon can be seen.

Figure 3:
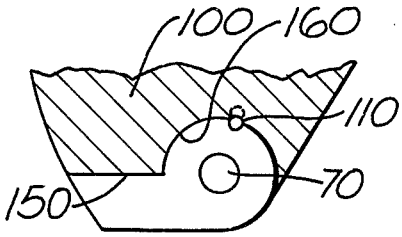
FIG. 3 shows the base of the trigger mount in the firearm housing.

In FIG. 3, the trigger mount 100 has a retaining pin 70 a flat surface 150 against which the trigger 20 in FIGS. 1 & 2 acts to fire the weapon and a pressure releasing ball 110 to lock the trigger in position in the recess 160 that receives the round upper edge (140 in FIG. 2) of the trigger (20 in FIGS. 1 and 2).

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A removable safety trigger for firearms, comprising:

a firearm housing (50) forming a recess (40), a trigger mount (100) mounted in the housing, the trigger mount (100) forming a recess (160), a retaining pin (70) attached to the trigger mount centered in the recess (160), a pressure releasing ball (110) mounted in the recess (160), the trigger mount (100) forming a flat surface (150), a removable safety trigger (20) mounted in the trigger mount (100), whereby the trigger may rotatably act on the flat surface (150) to fire the firearm, the trigger (20) forming a flat surface (145) that acts on the flat surface (150) of the mount (100), the trigger forming a round upper edge (140), the round upper edge (140) forming a pressure releasing ball socket (130), the round upper edge (140) forming a slot (60), whereby the trigger (20) may slidingly engage the retaining pin (70) of the mount (100), and the trigger may be removed when the trigger is rotated to engage the firearm housing recess (40), and the trigger (20) forming a key chain hole (120).

* * * * *